US009909279B2

(12) United States Patent
D'Amico et al.

(10) Patent No.: US 9,909,279 B2
(45) Date of Patent: Mar. 6, 2018

(54) BOOM LOCKOUT DEVICE FOR HYDRAULIC FRONT SHOVEL

(71) Applicant: Certified Tool Technologies, Inc., Buffalo, WY (US)

(72) Inventors: John A. D'Amico, Casper, WY (US); Dennis A. Frank, Buffalo, WY (US)

( * ) Notice: Subject to any disclaimer, the term of this patent is extended or adjusted under 35 U.S.C. 154(b) by 436 days.

(21) Appl. No.: 14/692,603

(22) Filed: Apr. 21, 2015

(65) Prior Publication Data

US 2016/0312445 A1 Oct. 27, 2016

(51) Int. Cl.
*F15B 15/26* (2006.01)
*E02F 3/38* (2006.01)

(52) U.S. Cl.
CPC ..... *E02F 3/388* (2013.01); *F15B 15/261* (2013.01)

(58) Field of Classification Search
CPC ..... F15B 15/261
See application file for complete search history.

(56) References Cited

U.S. PATENT DOCUMENTS

| | | | |
|---|---|---|---|
| 3,135,555 | A | 6/1964 | Caskey |
| 3,662,653 | A | 5/1972 | Carlson et al. |
| 4,122,758 | A | 10/1978 | Bieringer et al. |
| 4,373,851 | A | 2/1983 | Confoey |
| 4,413,944 | A | 11/1983 | Coe |
| 5,983,684 | A | 11/1999 | Boisvert |
| 6,520,067 | B1 | 2/2003 | Hunt et al. |
| 6,698,114 | B2 | 3/2004 | Bares et al. |
| 6,874,338 | B1 | 4/2005 | Hunt et al. |
| 2003/0079379 | A1 | 5/2003 | Bares et al. |

*Primary Examiner* — F. Daniel Lopez
(74) *Attorney, Agent, or Firm* — Antoinette M. Tease

(57) ABSTRACT

A boom lockout device for use with a hydraulic front shovel comprising a first half and a second half, each of which comprises a flat ceiling and two flat side walls. The ceiling is situated between the two side walls and is joined to the two side walls along a longitudinal edge of the ceiling. The angle between the ceiling and each of the two side walls is approximately ninety degrees. The first half and the second half are bolted together around the cylinder rod. The boom lockout device is installed between the barrel and the mount of the boom cylinder to prevent the rod from retracting into the barrel.

8 Claims, 6 Drawing Sheets

BOOM LOCKOUT DEVICE FOR HYDRAULIC FRONT SHOVEL

BACKGROUND OF THE INVENTION

1. Field of the Invention

The present invention relates generally to the field of heavy machinery, and more specifically, to a boom lockout device for a hydraulic front shovel.

2. Description of the Related Art

A hydraulic front shovel, which is a type of excavator, is comprised of a series of hydraulically operated cylinders that control the functionality of the shovel boom, shovel stick and shovel bucket. As part of the routine maintenance and servicing of a hydraulic shovel, some or all of these hydraulic cylinders need to be removed periodically for repair or replacement. During such time, the shovel bucket is positioned on the ground, and the boom and stick are arranged in a peaked position (see FIG. 1) so that their respective cylinders are only partially retracted.

With the stick cylinders removed, the bracing ability of the stick against the bucket is compromised. Depending on the rested position of the bucket, ground conditions under the bucket, and the integrity of the hydraulic system and its operating components (valves, hoses, connections, etc.), the weight of the boom may cause the stick to move forward, thereby allowing the boom to drop until the front of the boom wedges against the rear of the stick or the boom cylinder fully retracts, which stops the downward motion of the boom. This creates an unsafe and dangerous situation if there are people in the immediate area adjacent to and below the boom. To alleviate this situation, the inventors of the present invention have designed a mechanical stop that attaches around the rod end of the boom cylinders to prevent them from fully retracting under the weight of the boom. When the present invention is in place, it forms a long, solid brace with the barrel of the boom cylinder and prohibits the rod from retracting back into the barrel.

The prior art includes a number of similar safety and/or anti-theft devices, none of which possesses the structural features and advantages of the present invention. For example, U.S. Pat. No. 3,135,555 (Caskey, 1964) discloses a safety guard for the ram of a hydraulic hoist. The safety guard is comprised of two hingedly connected tubular halves. U.S. Pat. No. 3,662,653 (Carlson et al., 1972) provides a safety lock for a linear fluid pressure actuator for use in connection with a hydraulic ram having a cylinder body, a piston rod, a clevis and a connecting pin extending between the legs of the clevis. The safety lock prevents retraction of the piston rod and is comprised of a rigid, elongated spacer of generally U-shaped cross-section, the spacer having a pair of arms with apertures for receiving a portion of the connecting pin, and the apertures being sized to permit limited movement of the spacer relative to the clevis.

U.S. Pat. No. 4,122,758 (Bieringer et al., 1978) discloses a service support for blocking the lift arm of a bucket in an extended position during servicing and repair of the lift arm structure. The service support is U-shaped, and pads are provided an the end of the service support to contact the mounting bracket for better distribution of loads. Attachment members mounted on the service support engage with a plate assembly to bridge the open space between the sides of the service support. U.S. Pat. No. 4,373,851 (Confoey, 1983) provides a locking device to prevent theft of a bulldozer or backhoe. The locking device is comprised of an elongated sleeve that fits over a piston rod in its extended position, the sleeve having two halves in the shape of half circular portions of an annular flange. The locking device further comprises outwardly extending arms that are arranged to cover the pivoted portions of the machine.

U.S. Pat. No. 4,413,944 (Coe, 1983) discloses a telescopic locking strut for a tractor front loader. The locking strut is comprised of mutually slideable members and is housed partially within one of the two channel structures of the front loader support frame. The strut is pivotable between a retracted inoperable position and an extended operative position in which it locks the boom on the channel structure in a raised position. U.S. Pat. No. 5,983,684 (Boisvert, 1999) provides an anti-theft device for locking a fluidic piston-cylinder actuator in an extended piston position. The device is comprised of an elongate strut wall member having an arcuate wall portion with a pair of side wall portions space apart so as to define an elongate channel extending between the first and second ends of the strut wall member. This channel receives the extended piston portion of the actuator.

U.S. Pat. No. 6,520,067 (Hunt et al., 2003) discloses a hydraulic piston locking device with a split sleeve configuration and opposed longitudinally extending edges that are locked to one another with a locking means, which is partially enclosed within a lock protecting housing. U.S. Pat. No. 6,698,114 (Bares et al., 2004) provides a hit arm assembly with a support strut that is stored in a front tubular cross member of the lift arm assembly. The front cross member also supports an upright strut that projects upwardly beyond the bucket top and acts as a back stop for material in the bucket.

U.S. Pat. No. 6,874,338 (Hunt et al., 2005) discloses a hydraulic piston locking device having a hollow sleeve configuration formed of hingedly connected first and second sleeve parts. A first lock secures the first and second sleeve members to one another along a longitudinally extending parting line, and a second lock is opposed to the first lock and prevents hinged movement of the first and second sleeve parts.

BRIEF SUMMARY OF THE INVENTION

The present invention is a boom lockout device for use with a hydraulic front shovel the hydraulic front shovel comprising a boom cylinder having a barrel, a nose, a rod and a mount, the boom lockout device comprising: a first half and a second half, each of the first and second halves comprising a ceiling and two side walls, wherein the ceiling is flat and is situated between the two side walls, wherein the two side walls are flat, wherein the ceiling is joined to each of the two side walls along a longitudinal edge of the ceiling, and wherein the angle between the ceiling and each of the two side walls is approximately ninety degrees; wherein the first half and the second half are bolted together around the cylinder rod; wherein the boom lockout device is installed between the barrel and the mount of the boom cylinder to prevent the rod from retracting into the barrel.

In a preferred embodiment, each of the first half and second half further comprises a first connection plate that is perpendicular to a first side wall and a second connection plate that is perpendicular to a second side wall, each of the two connection plates extends longitudinally from an end plate on a first end of the device to a second end of the device, a longitudinal edge of the first connection plate is situated directly underneath an outer edge of the first side wall and a longitudinal edge of the second connection plate is situated directly underneath an outer edge of the second side wall, and the connection plates on each of the first and second halves are configured so that they are aligned with one another when the device is installed.

In a preferred embodiment, each of the first half and second half farther comprises a plurality of support brackets attached to the first and second side walls, each support bracket is triangular in shape and comprises a base and a side that is perpendicular to the base, the base of the support bracket rests on an outer surface of the first or second connection plate, and the side of the support bracket that is perpendicular to the base is attached to an outer surface of the first or second side wall. Preferably, each of the first and second halves comprises at least one lift eye situated on an outer surface of the first or second side wall between the end plate and a first support bracket in the plurality of support brackets, and a base of the lift eye is parallel with the connection plate.

In a preferred embodiment, each of the first and second halves comprises a plurality of gussets situated inside of the half and arranged parallel to one another along a length of the half from the end plate on the first end of the half to the second end of the half each gusset has a top edge that is attached to an inner surface of the ceiling and two side edges that are attached to an inner surface of each of the two side walls, each gusset has a concave cutout with an inner diameter that is larger than an outside diameter of the cylinder rod, and the cylinder rod extends through the concave cutouts in each of the gussets when the device is installed. Preferably, the invention further comprises plastic liners on either side of at least a subset of the plurality of gussets, wherein the plastic liners lie flat against the gussets and comprise concave cutouts that are slightly smaller than the concave cutouts in the gussets.

In a preferred embodiment, each of the first and second halves further comprises an elongated support member that is situated on top of an outer surface of the ceiling and that is perpendicular to the ceiling. Preferably, the end plate on each of the first and second halves is semicircular in shape, the device further comprises an adapter plate that is semicircular in shape, the end plate has an inner diameter that is greater than the inner diameter of the concave cutouts in the gussets but smaller than an inner diameter of the adapter plate, the adapter plate lies between the end plate and a first flange that is semicircular in shape, the adapter plate and first flange have the same inner diameter as a second flange that is semicircular in shape, the first flange is bolted to the adapter plate, and the adapter plate is welded to the end plate.

The invention preferably further comprises a plurality of spacers situated between the first and second flanges, wherein the spacers are arranged radially around a circumference of the first and second flanges. In a preferred embodiment, the ceiling and two side walls of each of the first and second halves form a box shape, and the concave cutouts of the gussets and liners form a circular opening through which the cylinder rod extends. The nose of the boom cylinder is preferably situated inside of both the first flange and the second flange and at least a portion of the adapter plate but terminates short of the end plate when the device is installed on the cylinder rod.

REFERENCE NUMBERS

Figure 1:
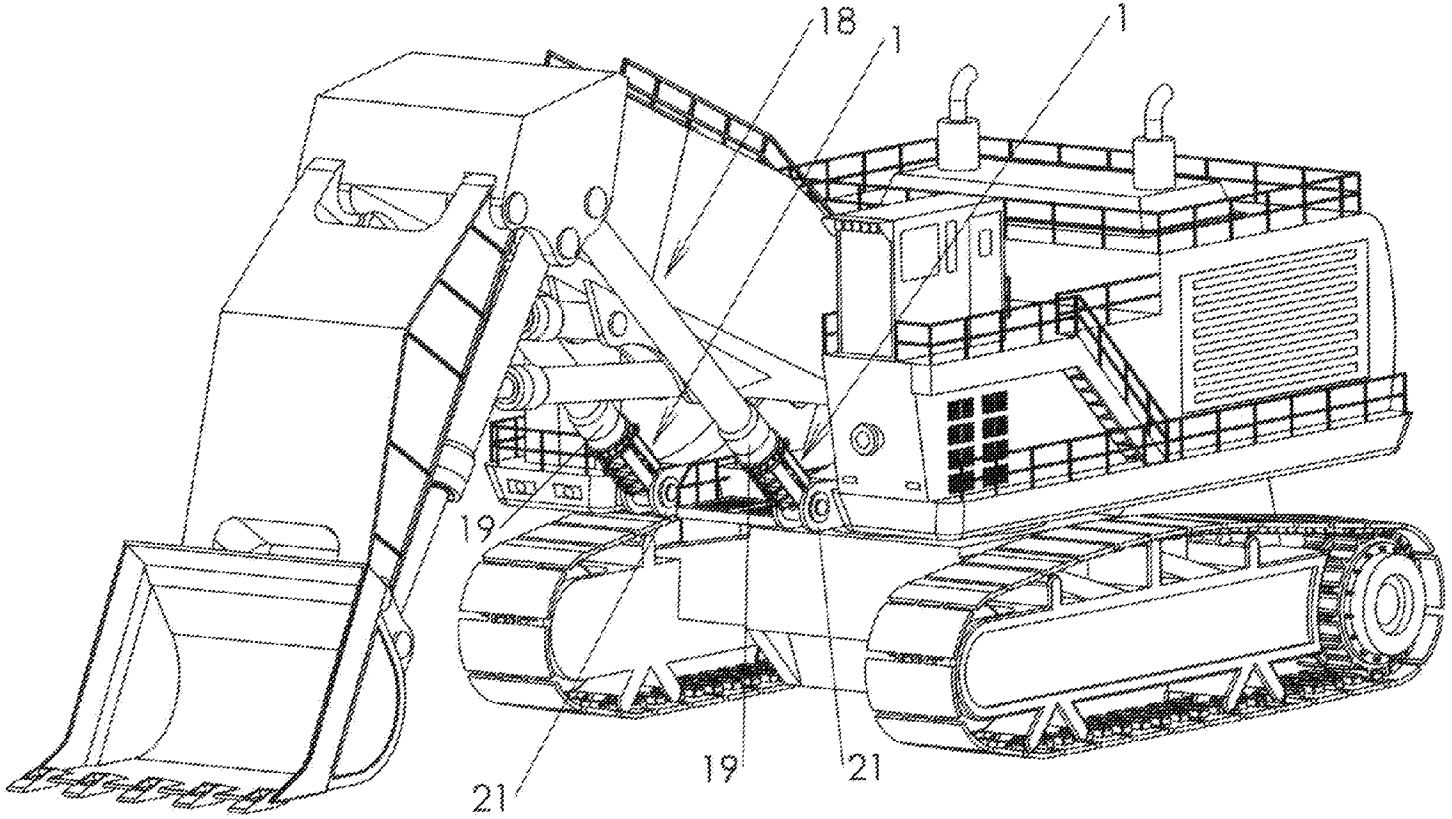
FIG. 1 is a perspective view of the boom lockout device of the present invention installed on a hydraulic front shovel.

1 Boom lockout device
2 First half (of boom lockout device)
3 Second half (of boom lockout device)
4 Ceiling
5 Elongated support member
6 Side wall
7 Support bracket
8 Lift eye
9 Connection plate
10 Gusset
11 Liner
12 End plate
13 Adapter plate
14 First flange
15 Spacer
16 Second flange
17 Bolt
18 Hydraulic cylinder
19 Barrel (of hydraulic cylinder)
20 Rod (of hydraulic cylinder)
21 Cylinder mount
22 Nose (of hydraulic cylinder)

DETAILED DESCRIPTION OF INVENTION

FIG. 1 is a perspective view of the boom lockout device of the present invention installed on a hydraulic front shovel. As shown in this figure, the front shovel comprises two boom cylinders 18, each of which comprises a barrel 19, a rod 20 and a cylinder mount 21. The lockout device 1 of the present invention is installed between the barrel 19 and the mount 21, and it prevents the rod 20 from retracting into the barrel 19 (see FIG. 5).

Figure 2:
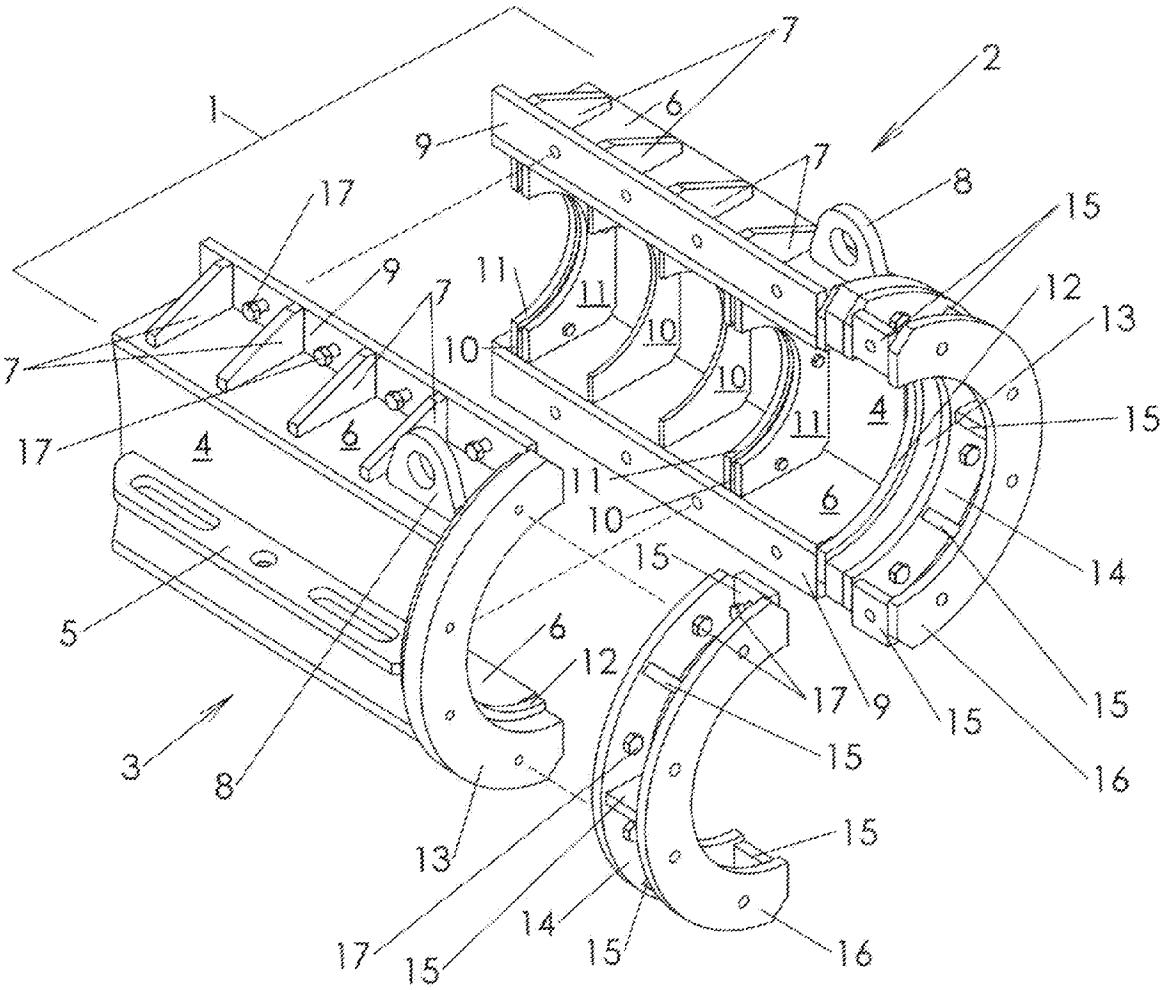
FIG. 2 is an exploded view of the boom lockout device.
Figure 6:
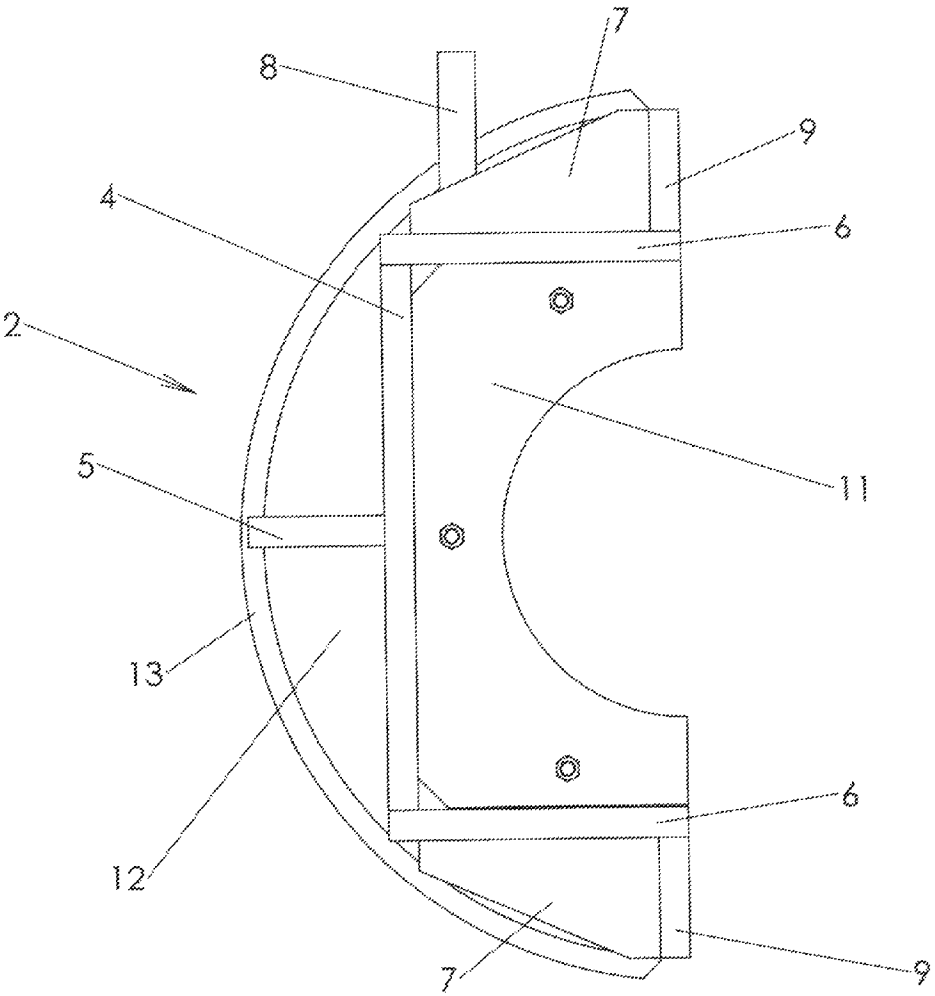
FIG. 6 is a lateral section view of the boom lockout device.

FIG. 2 is an exploded view of the boom lockout device. As shown in this figure, the present invention comprises two halves 2, 3 that are bolted together around the cylinder rod 20. Each half 2, 3 comprises a ceiling 4 and two side walls 6. The ceiling 4 and side walls 6 are each preferably flat and the ceiling 4 is situated between the two side walls 6 with the ceiling 4 being joined to a side walls 6 along each longitudinal edge of the ceiling 4. The angle between the ceiling 4 and each side wall 6 is preferably approximately ninety degrees (90°) (see FIG. 6).

At the bottom edge of each side wall 6 (that is, the edge of the side wall 6 that is not attached to the ceiling 4) is a connection plate 9. The connection plate 9 is perpendicular to the side wall 6 and extends longitudinally from the end plate 12 to the opposite end of the device (that is, the end of the device that is opposite the first and second flanges 14, 16). Preferably, one longitudinal edge of the connection plate 9 is situated directly underneath the outer edge of the side wall 6, as shown. The connection plates 9 on the halves 2, 3 are configured so that they are aligned with one another the connection plate 9 on one half 2 is aligned with a corresponding connection plate 9 on the other half 3) when the device is installed. When the device is installed, the connection plates 9 on one half 2 are bolted to the connection plates 9 on the other half 3. For ease of reference, the surface of each connection plate 9 that abuts up against a surface of the corresponding connection plate 9 will be referred to as the "inner surface" of the connection plate 9, the "outer surface" of the connection plate being the surface upon which the support brackets 7 rest.

On the outside of each of the side walls is a plurality of support brackets 7. In a preferred embodiment, each support bracket 7 is triangular in shape with the short side (or base) of the triangle resting on the outer surface of the connection plate 9 and the long side (that is, the side of the triangle that is perpendicular to the base) of the triangle being attached to the outer surface of the side wall 6. In a preferred embodiment, each half 2, 3 comprises a lift eye 8; the lift eyes 8 are used to lift the device onto or off of the cylinder rod 20 or to transport it from one location to another. As shown, the lift eyes 8 are situated on the outer surface of the side wall 6, preferably between the end plate 12 and the first support bracket 7 in the plurality of support brackets 7. Each lift eye 8 is preferably rounded in shape with a central aperture and a base. The base of the lift eye 8 is attached to the outer surface of the side wall such that the base is parallel with the connection plate 9. Note that the two halves 2, 3 are identical except with respect to the positioning of the lift eyes, which are positioned directly opposite one another on the respective halves 2, 3, as shown in FIG. 2.

In a preferred embodiment, a plurality of gussets 10 is situated inside of the device and arranged parallel to one another along the length of the device (from the end plate 12 to the opposite end of the device). The gussets 10 are preferably comprised of steel, and each gusset 10 has a top edge that is attached to the inner surface of the ceiling 4 and two side edges that are attached to the inner surface of each of the side walls 6. Each gusset 10 has a concave (or semicircular) cutout, the inner diameter of which is larger than the outside diameter of the cylinder rod 20. When the device is installed, the cylinder rod 20 extends through the cutouts in the gussets 10. The concave cutout is configured so as to leave a base edge of the gusset 10 on either side of the concave cutout. In a preferred embodiment, the radius of the concave cutout in the gusset 10 is 5.88 inches, and the radius of the cylinder rod (to its outer surface) is 5.25 inches; therefore, there is a difference of 0.63 inches between the outer surface of the cylinder rod and the inner surface of the cutout in the gusset 10.

In the embodiment shown in FIG. 2, the two gussets 10 on either end of the plurality of gussets 10 are surrounded by liners 11 on either side of the gusset. The liners 11 lie flat against the gussets 10 and are shaped similarly to the gusset 10, except that the concave cutouts in the liners 11 are slightly smaller than the concave cutouts in the gusset 10 so that the inner diameter of the concave cutouts in the liners 11 is smaller than the inner diameter of the concave cutouts in the gussets 10 but still slightly larger than the outer diameter of the cylinder rod 20. The liners are preferably made of plastic, and their purpose is to provide a buffer between the outside surface of the cylinder rod 20 and the steel gussets 10. The liners 11 are preferably bolted or screwed to the gussets 10. The base ends of the gussets 10 and liners 11 are parallel to the inner and outer surfaces of the connection plates 9. In a preferred embodiment the radius of the concave cutout in the liner 11 is 5.31 inches, and the radius of the cylinder rod (to its outer surface) is 5.25 inches; therefore, there is a difference of 0.06 inch between the outer surface of the cylinder rod and the inner surface of the cutout in the liner 11.

In a preferred embodiment, an elongated support member 5 is situated on top of the ceiling 4 on the outer surface of the device. The elongated support member 5 provides structural support to the device. The elongated support member 5 preferably extends nearly the entire length of the ceiling 4, is perpendicular to the ceiling 4, and is positioned roughly in the center of the ceiling 4. It preferably comprises two longitudinal apertures for attachment of a clevis, strap or other object.

The ceiling 4, side walls 6 and connection plates 9 all abut up against the end plate 12 on one end of the device. The end plate 12 is annular in shape (when the two halves are put together) and has an inner diameter that is greater than the inner diameter of the gussets 10 and liners 11 but smaller than the inner diameter of the adapter plate 13. The adapter plats 13 is also annular in shape (when the two halves are put together) and lies between the end plate 12 and the first flange 14, which is also annular (when the two halves are put together). The adapter plate 13, first flange 14 and second flange 16, which is also annular in shape (when the two halves are put together), preferably have the same inner diameter. The first flange 14 is bolted to the adapter plate 13, which is welded to the end plate 12. A plurality of spacers 15 is situated between the first and second flanges 14, 16. The width of the spacers 15 may be adjusted (by providing spacers 15 of smaller or larger widths) to increase or decrease the distance between the first and second flanges 14, 16. This adjustability is desirable to accommodate different cylinder sizes (in particular, different lengths of the cylinder nose; see FIG. 6).

The adapter plate 13 must be thick enough to accommodate the threads on the bolts that secure the first flange 14 to the adapter plate 13. The reason the end plate 12 has a smaller inner diameter than that of the adapter 13 is to provide a weld land so that the adapter plate 13 can be welded to the end plate 12.

Figure 3:
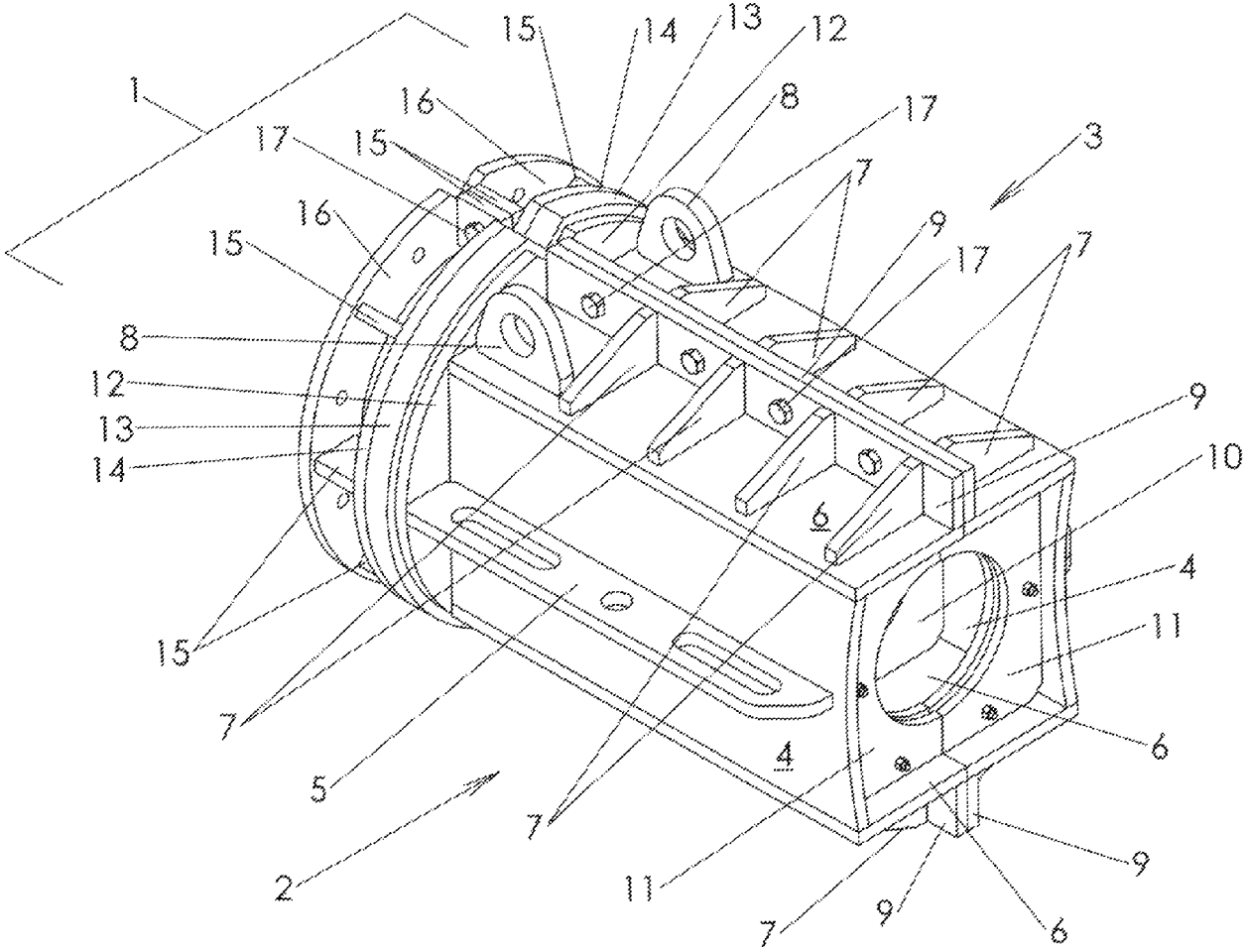
FIG. 3 is a perspective view of the boom lockout device shown fully assembled.

FIG. 3 is a perspective view of the boom lockout device shows fully assembled. All of the individual components of the device have been previously described. As shown here, when installed, the ceiling 4 and side walls 6 form a box shape, and the concave cutouts of the gussets 10 and liners 11 form a circular opening through which the cylinder rod 20 extends. This figure also shows the alignment of the connection plates 9 and support brackets 7 when the device is installed. Note that the two terminal spacers 15 on each of the two halves 2, 3 abut up against one another so that their primary surfaces lie against one another. This forms a solid support at the point at which the two flanges 14, 16 are joined. The remaining spacers 15 are arranged radially around the circumference of the flanges 14, 16.

Figure 4:
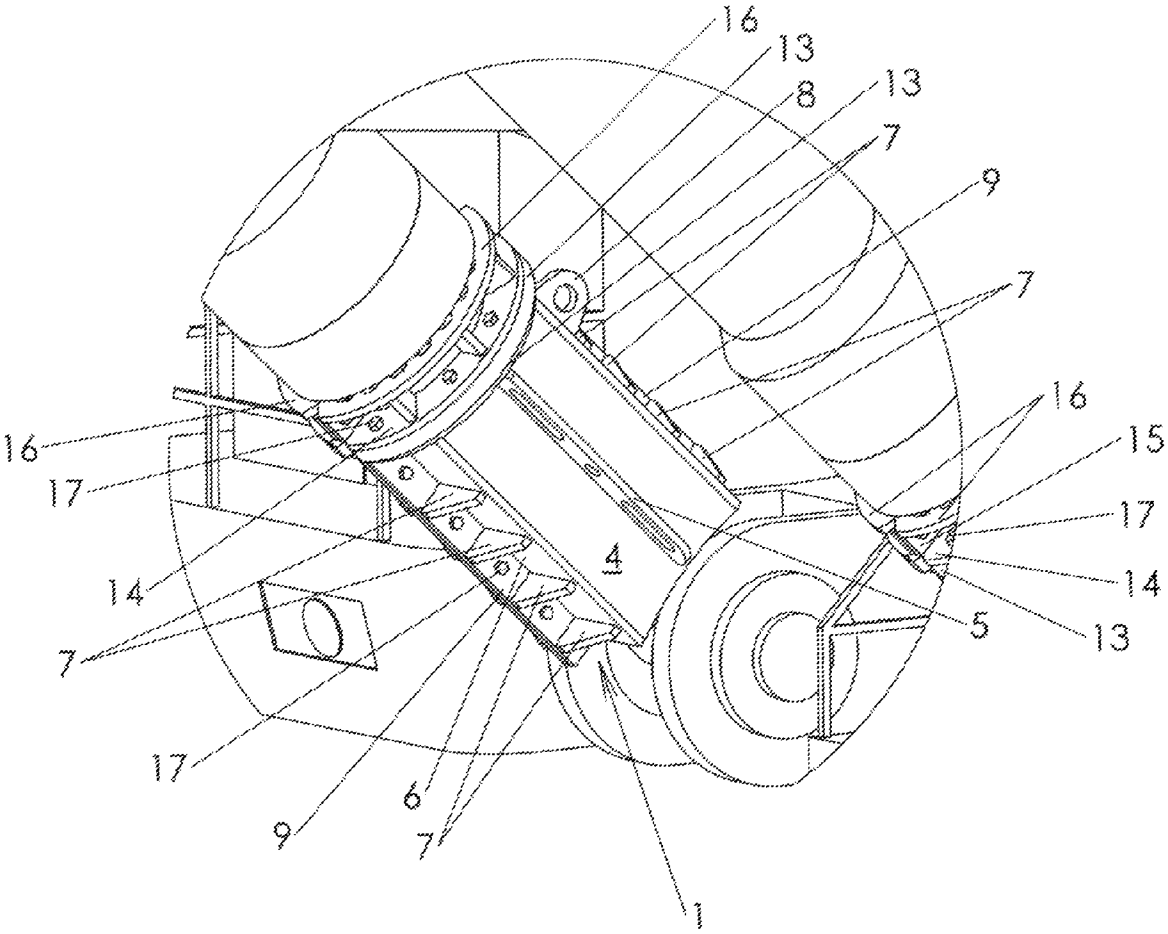
FIG. 4 is a detail perspective view of the boom lockout device shown fully assembled and installed on a hydraulic front shovel.
Figure 5:
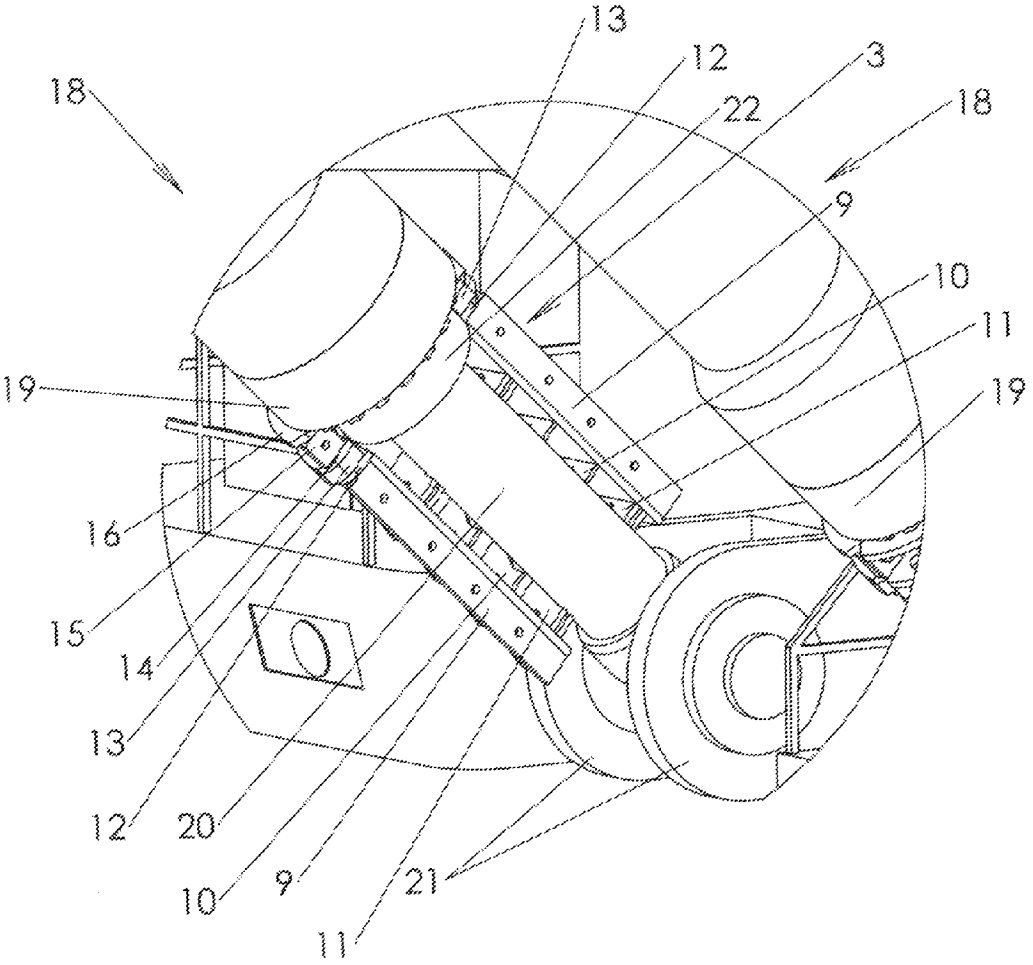
FIG. 5 is a detail perspective view of the boom lockout device shown with only one half of the device installed on a hydraulic front shovel.

FIG. 4 is a detail perspective view of the boom lockout device shown fully assembled and installed on a hydraulic front shovel, and FIG. 5 is a detail perspective view of the boom lockout device shown with only one half of the device installed on a hydraulic front shovel. Note that the bottom surface of the barrel 10 abuts up against the top (or outer) surface of the second flange 16. The nose 22 is situated inside of both flanges 14, 16 and a portion of the adapter plate 13 but terminates short of the end plate 12.

Although the preferred embodiment of the present invention has been shows and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A boom lockout device for use with a hydraulic front shovel, the hydraulic front shovel comprising a boom cylinder having a barrel, a nose, a rod and a mount, the boom lockout device comprising:

a first half and a second half, each of the first and second halves comprising a ceiling and two side walls, wherein the ceiling is flat and is situated between the two side walls, wherein the two side walls are flat, wherein the ceiling is joined to each of the two side walls along a longitudinal edge of the ceiling, and wherein the angle between the ceiling and each of the two side walls is approximately ninety degrees;

wherein the first half and the second half are bolted together around the cylinder rod;

wherein the boom lockout device is installed between the barrel and the mount of the boom cylinder to prevent the rod from retracting into the barrel; and wherein each of the first half and second half further comprises a first connection plate that is perpendicular to a first side wall and a second connection plate that is perpendicular to a second side wall;

wherein each of the two connection plates extends longitudinally from an end plate on a first end of the device to a second end of the device; and wherein the connection plates on each of the first and second halves are configured so that they are aligned with one another when the device is installed.

2. The boom lockout device of claim 1, wherein each of the first half and the second half further comprises a plurality of support brackets attached to the first or second side wall, wherein each support bracket is triangular in shape and comprises a base and a side that is perpendicular to the base, wherein the base of the support bracket rests on an outer surface of the first or second connection plate, and wherein the side of the support bracket is attached to an outer surface of the first or second side wall.

3. The boom lockout device of claim 2, wherein each of the first and second halves comprises at least one lift eye situated on an outer surface of the first or second side wall between the end plate and a first support bracket in the plurality of support brackets, and wherein a base of the lift eye is parallel with the first or second connection plate.

4. The boom lockout device of claim 1, wherein each of the first and second halves comprises a plurality of gussets situated inside of the half and arranged parallel to one another along a length of the half from the end plate on the first end of the half to the second end of the half, wherein each gusset has a top edge that is attached to an inner surface of the ceiling and two side edges that are attached to an inner surface of each of the two side walls, wherein each gusset has a concave cutout with an inner diameter that is larger than an outside diameter of the cylinder rod, and wherein the cylinder rod extends through the concave cutouts in each of the gussets when the device is installed.

5. The boom lockout device of claim 4, further comprising plastic liners on either side of at least a subset of the plurality of gussets, wherein the plastic liners lie flat against the gussets and comprise concave cutouts that are slightly smaller than the concave cutouts in the gussets.

6. The boom lockout device of claim 4, wherein the end plate on each of the first and second halves is semicircular in shape, wherein the device further comprises an adapter plate that is semicircular in shape, wherein the end plate has an inner diameter that is greater than the inner diameter of the concave cutouts in the gussets but smaller than an inner diameter of the adapter plate, wherein the adapter plate lies between the end plate and a first flange that is semicircular in shape, wherein the adapter plate and first flange have the same inner diameter as a second flange that is semicircular in shape, wherein the first flange is bolted to the adapter plate, and wherein the adapter plate is welded to the end plate.

7. The boom lockout device of claim 6, further comprising a plurality of spacers situated between the first and second flanges, wherein the spacers are arranged radially around a circumference of the first and second flanges.

8. The boom lockout device of claim 6, wherein the nose of the boom cylinder is situated inside of both the first flange and the second flange and at least a portion of the adapter plate but terminates short of the end plate when the device is installed on the cylinder rod.

* * * * *